US005832795A

United States Patent [19]

Reynolds

[11] Patent Number: 5,832,795

[45] Date of Patent: Nov. 10, 1998

[54] OPEN-END RATCHET WRENCH

[76] Inventor: Roy W. Reynolds, P.O. Box 13246, Los Angeles, Calif. 13246

[21] Appl. No.: 146,572

[22] Filed: Oct. 29, 1993

Related U.S. Application Data

[62] Division of Ser. No. 970,766, Nov. 3, 1992, Pat. No. 5,282,830.

[51] Int. Cl.[6] ..... B25B 13/58

[52] U.S. Cl. ..... 81/180.1; 81/13

[58] Field of Search ..... 81/119, 124.3, 81/125, 180.1, 13, 185.02

[56] References Cited

U.S. PATENT DOCUMENTS 1,550,436 8/1925 Hall ..... 81/119

4,787,273 11/1988 Griffith ..... 81/125 X

*Primary Examiner*—James G. Smith

*Attorney, Agent, or Firm*—William L. Chapin

[57] ABSTRACT

A self-ratcheting wrench for applying torque to a polygonal cross-section body such as a bolt or nut has an elongated handle terminated at one end thereof by a head having an opening adapted to receive the nut. A plurality of three-sided pawls pivotable in a transverse plane are arranged around the opening and spring biased to place a flat face wall of the pawls against the flat sides of alternate nut faces. Motion of each pawl radially inward into the nut-receiving opening is limited by abutting contact of a first inner side wall of each pawl with a triangular-shaped stop, the abutting contact also providing means for transmitting torque applied to the handle of the wrench to the pawl and contacting nut. In the preferred embodiment, the second side wall of each pawl is convexly curved, and intersects the face wall of the pawl at an obtuse angle, both characteristics serving to facilitate sliding motion of the pawls over the faces of the nut when the wrench is orbited in a direction opposite to a torque-applying direction, during which ratcheting action pawls are pivoted radially outwards against spring tension.

14 Claims, 11 Drawing Sheets

12
21-8
B5
A
C6
C5
B6
B4
21-7
C4
C1
21-1
22
23
27A,27B,28
21-6
22
B1
B3
21-2
21-5
C3
21-4
21-3
C2
B2
27
14
32
31
30
25
24
17
30
30
26
F
10
11

OPEN-END RATCHET WRENCH

This is a divisional of Ser. No. 07/970,766 filed Nov. 3, 1992, now U.S. Pat. No. 5,282,830.

BACKGROUND OF THE INVENTION

A. Field of the Invention

The present invention relates to hand tools. More particularly, the invention relates to an open-end ratchet wrench for tightening and loosening nuts and bolts.

B. Description of Background Art

Wrenches used to tighten and loosen conventional bolts and nuts of the type having a polygonal cross-section head are available in a variety of types.

Typical open-end wrenches have an elongated straight handle terminated at one end by an enlarged, flat web having a generally oval plan view. A generally rectangular-shaped opening extending inward from the outer transverse wall of the web has opposed parallel walls adapted to contact opposed flat sides of a polygonal bolt head or nut. Applying a force normal to the longitudinal axis of the wrench handle, in a plane perpendicular to the longitudinal axis of the bolt, causes the contacting flat web walls to exert a torque couple on the bolt head, thus permitting the bolt to be tightened or loosened.

Box-end wrenches are similar in construction to open-end wrenches, but have a closed web with an aperture therethrough for receiving a bolt head or nut. The aperture has a generally circular shape, modified by a plurality (typically, 12) of radially inwardly projecting triangular protrusions called points. Each pair of adjacent sloping point faces defines a triangular-shaped indentation adapted to engage the intersection of a pair of intersecting polygonal faces, or vertex, of a nut. Torque is applied to flat sides of a nut or bolt head by faces on an opposed pair of points.

In many cases, confined spaces or obstructions prevent complete circular rotation of a wrench required to tighten or loosen a bolt. In such cases, the wrench head must be rotated until the handle of the wrench encounters an obstruction, removed from the bolt head, rotated in the opposite direction as far as possible, and re-engaged with the bolt head to initiate another loosening or tightening cycle. In confined spaces, the procedure described above can be time consuming and tedious. In such situations, a ratcheting wrench may be advantageously used.

Ratcheting socket wrenches include a cylindrical socket with an opening in one transverse end thereof having an internal cross-sectional shape similar to that of a box-end wrench as described above. The opposite transverse end of the socket is provided with a square opening to receive the drive pin of a ratcheting handle. Applying a normal force to the handle in one direction allows a nut engaged by the socket to be turned as far as desired, whereupon the handle may be swung back in the opposite direction. In the opposite or reverse direction, an internal ratcheting mechanism permits free rotation of the drive pin relative to the handle of the ratchet wrench. This ratcheting action permits rapid tightening or loosening of nuts and bolts even when the handle motion is restricted to a small fraction of a complete circular rotation, since the wrench does not need to be removed from the bolt head or nut each time a new torquing cycle is completed.

The advantages of a ratcheting action wrench have been recognized as being useful in open-end style wrenches, as evidenced by the following United States patents:

Hermanson, U.S. Pat No. 2,700,315, Jan. 25, 1955, Open-End Ratchet Wrench: Discloses an open-end ratchet wrench having two diagonally opposed, spring-biased, square-faced nut-face engaging dogs.

Cowell, U.S. Pat. No. 2,712,259, Jul. 5, 1955, Open Ended Ratchet Wrench: Discloses an open-ended ratchet wrench having a plurality of obliquely positioned coil spring dogs, each having a pointed end with a square notch therein for engaging the vertex of a polygonal nut. Also disclosed is an adapter having the shape of a hexagonal ring with one of its six legs removed, for inserting into the wrench and engaging smaller nuts.

Ford, U.S. Pat. No. 2,719,446, Oct. 4, 1955, Ratchet Wrench: Discloses a wrench operated by a pneumatic motor having a C-shaped wrench head oscillatably supported in a frame. The wrench had has two diametrically opposed pairs of adjacent spring biased cams having in plan view the shape of a circular disc with a sector cut out thereof, for engaging the vertices of a polygonal nut head.

Hertelendy, U.S. Pat. No. 3,927,582, Dec. 23, 1975, Open End One-direction Ratchet Wrench: Discloses a ratchet wrench construction including a plurality of square-faced nut engaging elements 23, as shown in FIGS. 8 and 9.

Blachly. U.S. Pat. No. 4,574,665, Mar. 11, 1986, Ratchet Wrench for Accommodating Both English and Metric-Sized Workpieces: Discloses an open end ratchet wrench having a plurality of cylindrical, eccentrally mounted, spring-biased cams for engaging a nut. Bailey, U.S. Pat. No. 4,644,830, Feb. 24, 1987, Ratchet Wrench: Discloses an open end ratchet wrench having a plurality of flexible swinging pawls which eliminate the need for separate hardened steel pawls and springs.

The present invention was conceived of to provide an open-end ratchet wrench of improved design.

OBJECTS OF THE INVENTION

An object of the present invention is to provide an open-end wrench having a self-ratcheting capability, whereby a torque may be applied to a bolt head or nut in a first rotation direction while the wrench may be orbited freely around the nut in an opposite direction, preparatory to applying another torque increment in the first direction.

Another object of the invention is to provide a self-ratcheting open-end wrench capable of selectably applying clockwise and counterclockwise torques to a polygonal body such as a bolt head or nut, without requiring any adjustments of the wrench.

Another object of the invention is to provide a self-ratcheting open-end wrench that is capable of applying a clockwise torque to a polygonal body with the wrench oriented in a first sense, and capable of applying a counter-clockwise torque with the wrench rotated 180 degrees around its longitudinal axis.

Another object of the invention is to provide a self-ratcheting open-end wrench having a plurality of pivotable pawls capable of simultaneously applying torquing forces to the faces of a polygonal body.

Another object of the invention is to provide a rachet wrench in which a side wall of each pawl intersects its outer, nut-engaging face at an obtuse angle, thereby facilitating smooth movement of the intersection over a nut face when ratcheting.

Another object of the invention is to provide a rachet wrench in which a side wall of each pawl is convex, thereby facilitating sliding motion across a nut face.

Another object of the invention is to provide a ratcheting wrench having three-sided pawls.

Another object of the invention is to provide a self-ratcheting open-end wrench having a plurality of nut-engaging pawls, each provided with a serrated surface to facilitate non-slip engagement of a nut face.

Another object of the invention is to provide a self-ratcheting open-end wrench having a sparse number of different types of component parts.

Another object of the invention is to provide a self-ratcheting open end wrench having a sparse number of total component parts.

Another object of the invention is to provide a self-ratcheting open-end wrench of simplified design and inherently low manufacturing cost.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved self-ratcheting open-end wrench, of the type useful for applying tightening and loosening torques to polygonal cross-section bodies, such as hexagonal or square bolt heads or nuts.

The improved self-ratcheting open-end wrench according to the present invention has an elongated generally flat handle portion. One end of the handle terminates in a generally crescent-shaped end portion or head having an arcuate generally circular cross-section opening extending inward from the outer face of the crescent-shaped end portion. Arranged around the inner perimeter of the opening are a plurality of pivotable, generally wedge-shaped dogs, pawls or arms. Each pawl is fastened to the encompassing part of the crescent-shaped end portion of the wrench by a separate transversely disposed pivot pin which permits pivotal motion of the pawl. A flat face wall on each pawl is urged into flat contact with an adjacent nut face by a plurality of torsion springs, on for each pawl. The tip of each pawl, located radially outward of the pivot pin, within the head of the wrench, abuts a separate one of a plurality of circumferentially spaced apart stops positioned within the crescent-shaped space within the head of the wrench. Orbital motion of the wrench head and pivot pins with respect to a nut or bolt head causes faces of alternate pawls to exert tangential forces on adjacent faces of the nut or bolt head. Abutting contact of each of the pawl tips with a stop limits pivotal motion of the pawl, causing the pawl face to cock slightly with respect to the nut face, while maintaining each pawl face irrotational with respect to a nut face. Applying a torque in the opposite direction causes the pawls to pivot radially outwards, i.e., into the crescent-shaped perimeter portion of the wrench and away from the stops, thereby allowing the wrench to be rotated or self-ratcheted around the nut. In the preferred embodiment, each pawl has a convex side wall which intersects the face wall at an obtuse angle, the obtuseness and convexity both facilitating sliding motion on a nut face during ratcheting.

DETAILED DESCRIPTION OF THE INVENTION

FIGS. 1 through 9 illustrate a basic embodiment of an improved open-end ratchet wrench according to the present invention.

Figure 1:
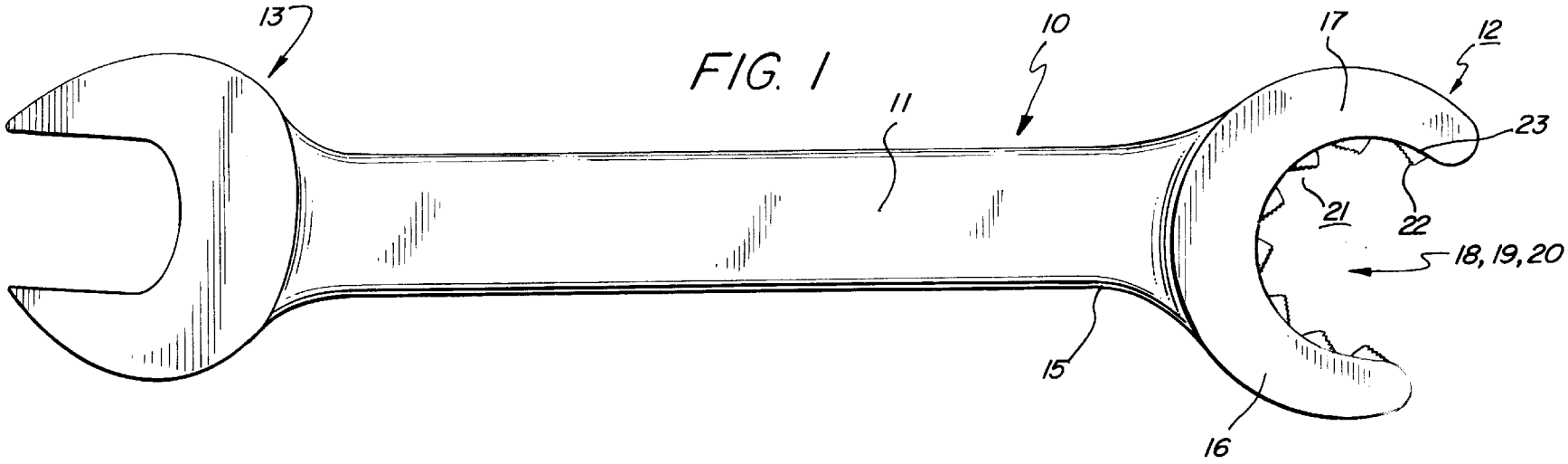
FIG. 1 is an upper plan view of a self-ratcheting open-end wrench according to the present invention.

Referring to FIG. 1, an open-end ratchet wrench 10 according to the present invention is shown to include an elongated, generally straight bar-shaped handle 11. One end of the handle is terminated by an enlarged, generally crescent-shaped head 12 containing a ratcheting nut engagement mechanism to be described below. Desirably, the opposite end of handle 11 may be terminated by a conventional, passive nut engaging head 13. FIG. 1 shows head 13 to be an open end, but it could of course be a box end if desired.

Figure 2:
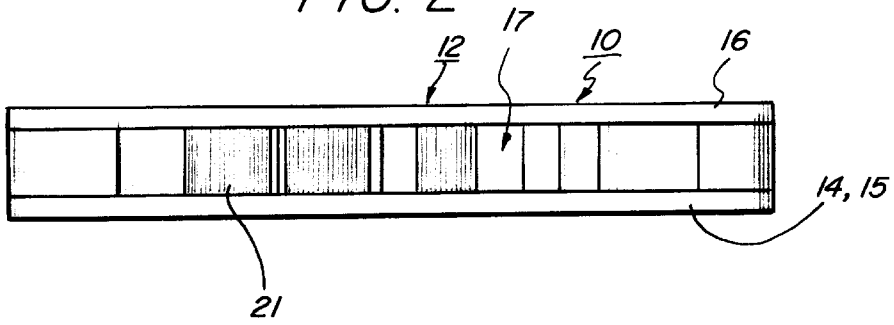
FIG. 2 is a front end elevation view of the wrench of FIG. 1.
Figure 6:
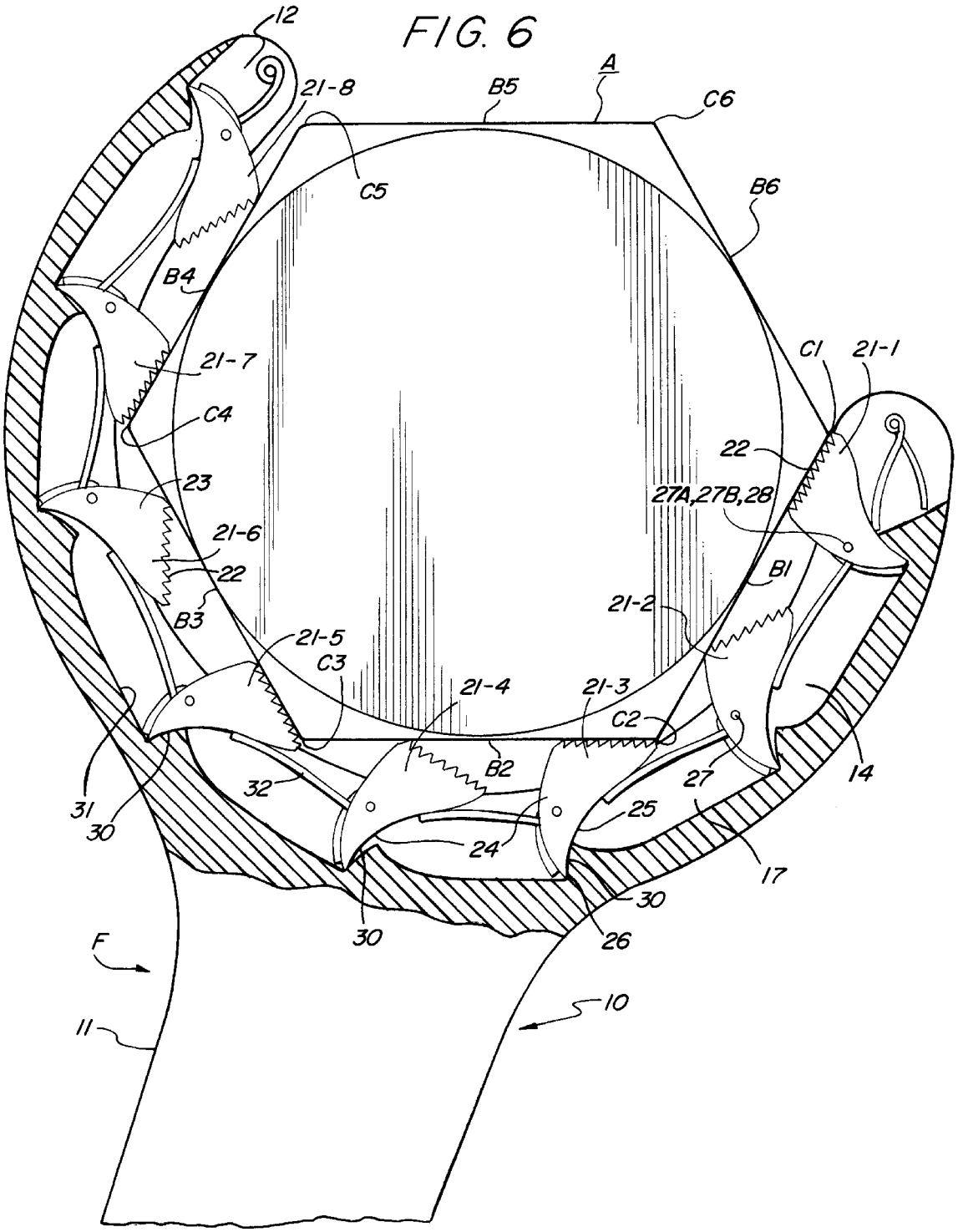
FIG. 6 is a fragmentary, partly sectional view similar to FIG. 1, but on a somewhat enlarged scale and showing a nut being engaged by the wrench preparatory to applying a counter-clockwise torque to the nut.

As shown in FIGS. 1 and 2, ratcheting head 12 includes a generally crescent-shaped web 14 formed in the end of handle 11. Web 14 has an outer surface contiguous with the lower surface 15 of handle 11. As may be seen best by referring to FIG. 2, web 14 has a thin, generally uniform cross-sectional shape. As may be seen best by referring to FIGS. 1 and 2, an upper crescent-shaped cover plate 16 similar in size and shape to lower crescent-shaped web 14 is attached to handle 11 of wrench 10, in vertical alignment with the web. Thus constructed, a crescent-shaped space 17 is formed between lower web 14 and upper cover plate 16. As may be seen best by referring to FIG. 1, web 14 and cover plate 16 have through their thickness dimensions aligned semi-circular openings 18 and 19, respectively, which define a semi-circular opening 20 in head 12, adapted to receive a nut or bolt head, as shown in FIG. 6.

As shown in FIGS. 1 and 2, a plurality of pawls 21 are pivotably attached to head 12 of wrench 10, and protrude radially inward into nut-engaging opening 20 of the head. The structure and function of pawls 21 may be best understood by referring to FIGS. 3 through 5, in addition to FIGS. 1 and 2.

Figure 4:
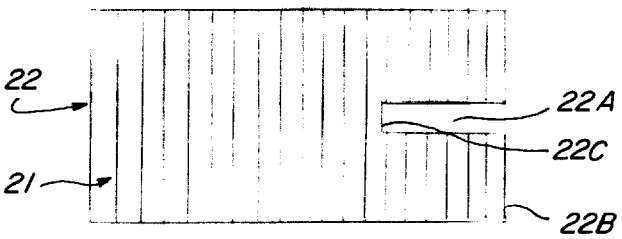
FIG. 4 is an upper plan view of part of the apparatus of FIG. 3.
Figure 3:
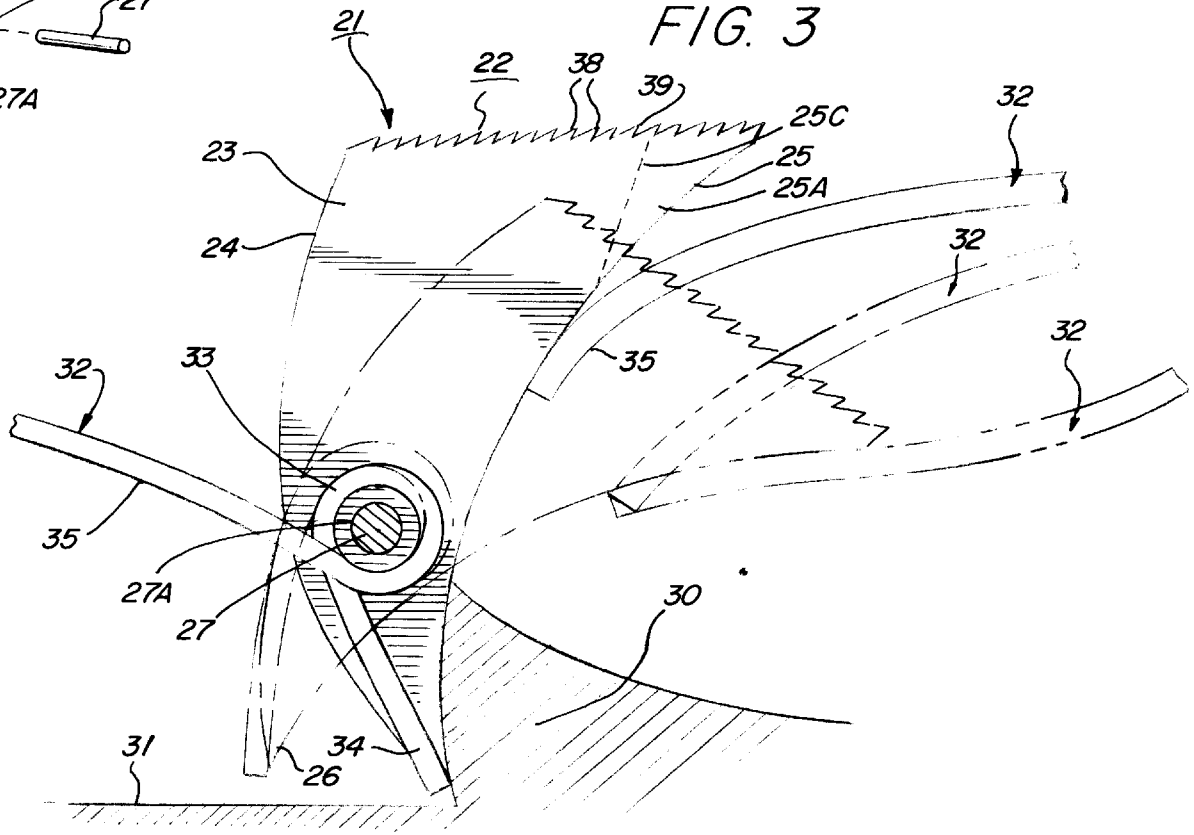
FIG. 3 is a fragmentary, partly sectional view on an enlarged scale of the wrench of FIG. 1.
Figure 5:
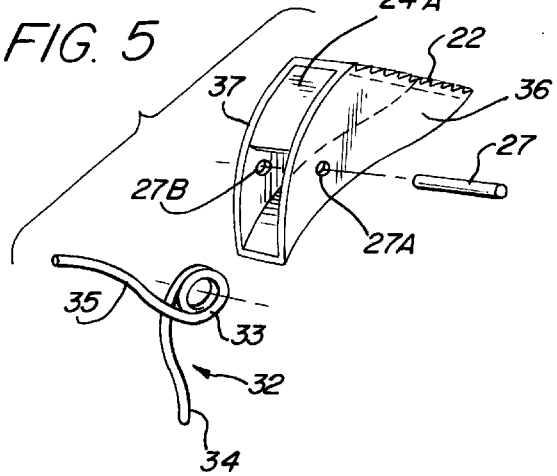
FIG. 5 is a perspective view of a pawl, spring and pivot pin forming part of the wrench shown in FIGS. 1 and 3.
Figure 9:
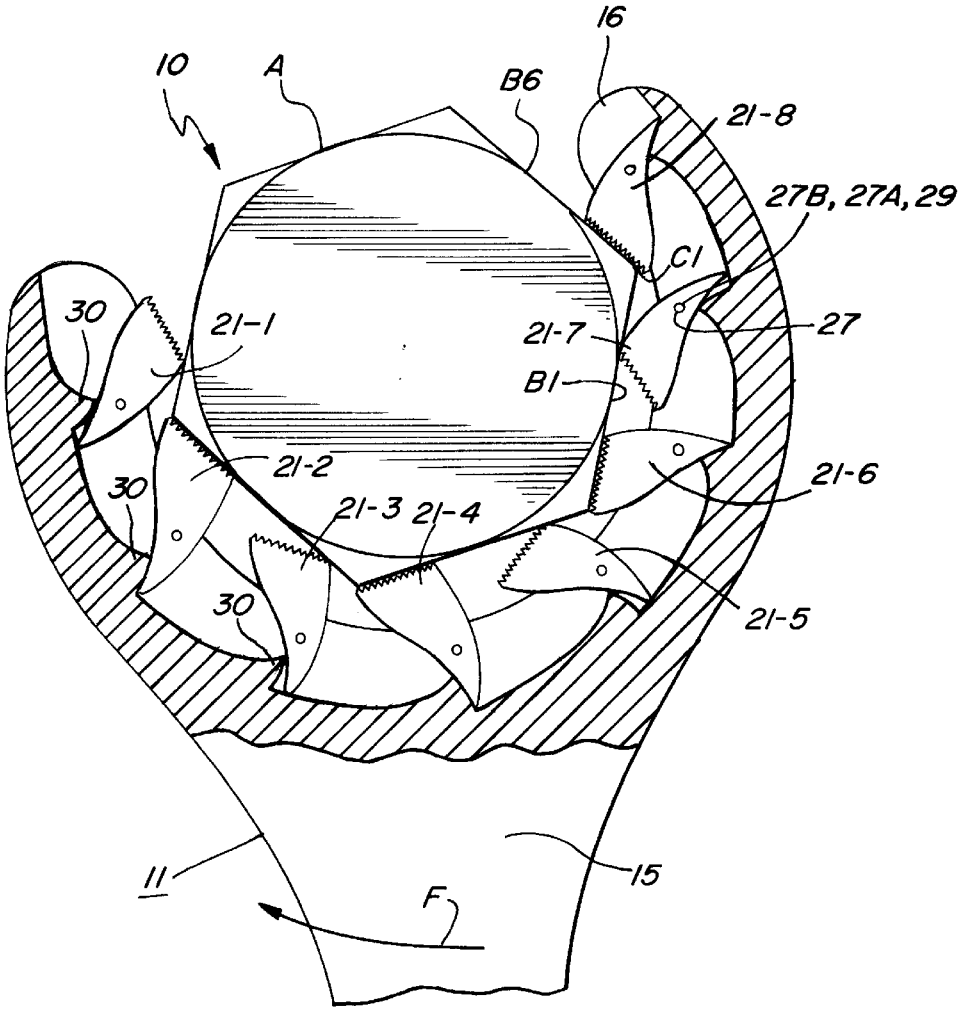
FIG. 9 is a view similar to that of FIG. 6, but showing the wrench flipped over to permit application of a clockwise torque to a nut.

As shown in FIGS. 3 through 5, each pawl 21 is of generally uniform transverse thickness, has a generally straight inner or front face wall 22, and a body 23 rearward of the front face having the general shape of a bent triangle or wedge. Thus, body 23 has a convex short edge wall 24 and a concave longer edge wall 25 which intersect at a triangular-shaped vertex or point 26. Each pawl 21 is pivotably attached to head 12 of wrench 10 by means of a separate transversely disposed pivot pin 27 which fits through aligned holes 27A and 27B in body 23 of pawl 21 and into an aligned pair of holes 28 and 29 in lower web 14 and cover plate 16, respectively, as shown in FIGS. 6 and 9.

In the preferred embodiment, slots are cut into face wall 22 and rear concave edge wall 25 of pawl 21, as will now be described. As may be seen best by referring to FIGS. 3 and 4, a rectangularly-shaped slot 22A is cut longitudinally inwards from that transverse edge wall 22B of face wall 22 that intersects rear concave edge wall 25 of pawl 21. Also, a perpendicularly aligned rectangular slot 25A is cut downwards in rear concave edge from intersecting edge wall 22B. The function of slots 22A and 25A will be described below.

Pawls 21, fastened to head 12 as described above, are free to pivot from space 17 between web 14 and cover plate 16, radially inward into opening 20 of the head. Radial inward motion of each pawl 21 is limited by contact of concave edge wall 25 of each pawl with a separate wedge-shaped stop 30. A plurality of circumferentially spaced apart stops 30 are formed in a curved radially outer wall 31, that extends perpendicularly upwards from lower web 14.

Each pawl 21 is elastically biased to its radially innermost position, with body 23 of the pawl abutting a stop 30, by means of wire torsion spring 32. Each torsion spring 32 has a central spiral loop 33 that fits coaxially over a pivot pin 27. Also, each torsion spring 32 has a shorter end length 34 adapted to abut convex wall 24 of a pawl 21 which the spring encircles, and a longer opposite end length 35 adapted to abut concave wall 25 of an adjacent pawl.

Figure 7:
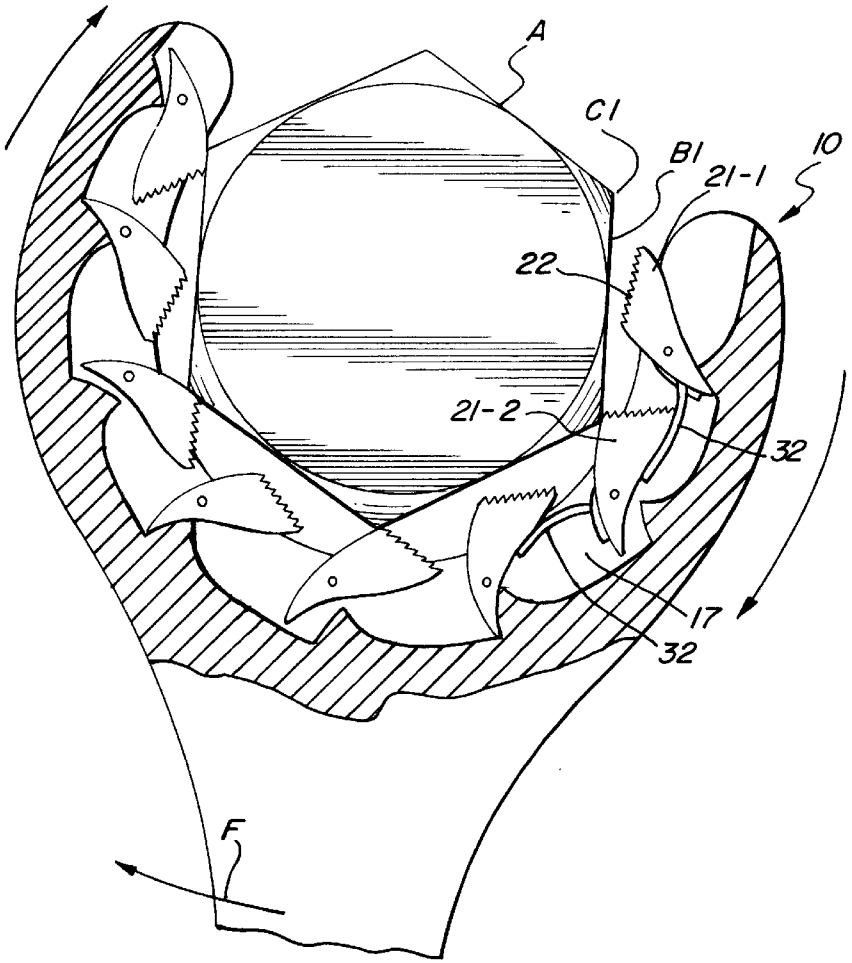
FIG. 7 is a view similar to that of FIG. 6, but showing the wrench being self-ratcheted in a clockwise sense.

With pawls 21 constructed and pivotably fastened to head 12 of wrench 10 as described above, each pawl is spring biased to a counter-clockwise, radially inward-most position limited by contact of the pawl with a stop 30, as shown in FIGS. 3 and 6. In this position, pawl 21 is irrotatable with respect to head 12 in response to counter-clockwise torques exerted on the pawl. This permits orbital motion of pivot pins 27 and pawl faces 22 to cause counter-clockwise tangential forces to be exerted on faces B of a nut A, providing a counter-clockwise torque on the nut when the wrench is turned in a counter-clockwise sense, as shown in FIG. 6. It should be noted that, although the tangential force exerted on a nut face by a contacting pawl face is clockwise with respect to the pivot axis of the pawl, the reaction torque, which causes the pawl face to cock somewhat with respect to a nut face, is counter-clockwise with respect to the pivot axis. When the wrench is turned in a clockwise sense, as shown in FIG. 7, each pawl 21 may be pivoted clockwise and depressed radially outward into web 14 of wrench 10, to afford a ratcheting action, as shown in phantom in FIG. 3.

As shown in FIG. 3, the concavity of rear edge wall 25 of pawl 21, in conjunction with the convexity of free end 35 of torsion spring 32, provides a longer force-applying area than could be achieved if the respective surfaces were straight. Thus, the structure of pawl 21 and spring 32 efficiently utilizes the limited size of crescent-shaped space 17 of wrench 10.

FIG. 3 also illustrates the function of slots 22A and 25A provided in pawl 21. As shown in FIG. 3, when pawl 21 is pivoted radially outward against the torsional force of torsion spring 32, long end 35 of the spring eventually abuts inner edge wall 22C of slot 22A and inner edge wall 25C of slot 25A. As shown in phantom in FIG. 3, slots 22A and 25A permit substantial pivotal motion of pawl 21 while only slightly straightening end 35 of torsion spring 32. If slots 22A and 25A were not provided, end 35 of torsion spring 32 would be distorted into the serpentine contour shown in dashed lines in FIG. 3, shortening the life of the spring.

FIG. 5 illustrates further construction details of a preferred embodiment of pawl 21. As shown in FIG. 5, pawl 21 may be hollow, having flat parallel upper and lower faces 36 and 37, respectively, a transversely disposed front or radially inward face wall 22, and a convex edge wall 24A which extends only partially along convex edge 24 of the pawl radially outward from face wall 22. Preferably, face wall 22 of pawl 21 is serrated, i.e., has formed therein a longitudinally disposed plurality of uniform, triangular transverse cross-section ridges 38. Ridges 38 form a corrugated surface 39 adapted to "bite into" a nut or bolt face.

The operation of wrench 10 may be best understood by referring to FIGS. 6 through 9.

FIG. 6 shows wrench 10 with a hexagonal nut or bolt head A centered in opening 20 of head 12. As shown in FIG. 6, alternate pawls 21-1, 21-3, 21-5, and 21-7 are positioned with their respective face walls 22 in flat contact with adjacent faces B1, B2, B3, and B4 of hex nut A. Now, when a normal force F is exerted on the handle 11 of wrench 10 in a counter-clockwise sense, a counter-clockwise torque is exerted by each pivot pin 27 supporting one of the aforementioned alternate pawls. That counter-clockwise torque is applied to the aforementioned adjacent faces of the hex nut by face walls 22 of the pawls 21. Even number pawls 21-2, 21-4, 21-6 and 21-8 are depressed radially outward partially into crescent-shaped space 17 between lower web 14 and cover plate 16 of head 12. Thus, even number pawls 21 are in an inactive or quiescent position for the configuration shown in FIG. 6.

Figure 8:
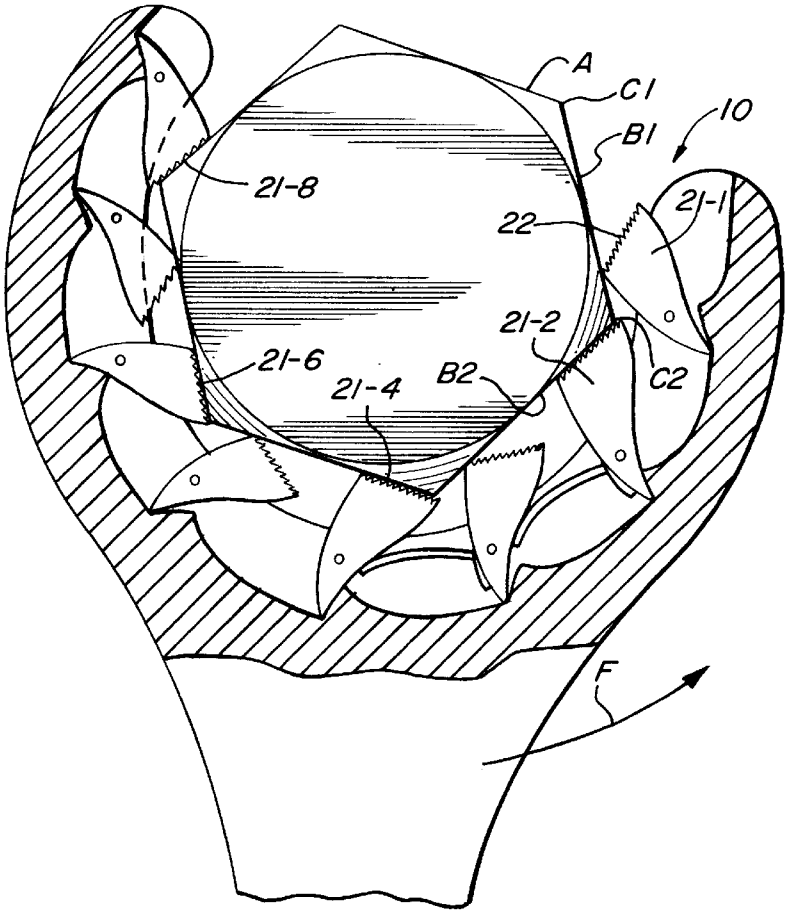
FIG. 8 is a view similar to FIG. 6, but showing the wrench having been ratcheted to a different position with respect to a nut than shown in FIG. 6, preparatory to applying another increment of counter-clockwise torque to the nut.

FIG. 7 illustrates the ratcheting operation of wrench 10. As shown in FIG. 7, applying a force F to handle 11 of wrench 10 in a direction resulting in a clockwise torque causes face wall 22 of each even-numbered pawl 21 which was formerly in a quiescent position, as shown in FIG. 6, to slide clockwise over a vertex C of nut head A. The obtuse intersection angle between face wall 22 and short side wall 24, and the convexity of the short side wall, facilitate sliding motion of pawl 21 over nut head A. Torsion of springs 32 permits the even-numbered pawls to move elastically into crescent-shaped space 17 in head 12, allowing the head to freely orbit nut head A in a clockwise direction. FIG. 8 shows wrench 10 having been rotated a minimum angular ratcheting increment, i.e., an increment permitting the nearest alternate pawl to engage a nut face B. Thus, FIG. 8 shows alternate, even-numbered pawls 21-2, 21-4, 21-6, and 21-8, abutting in flat contact, adjacent faces B of nut head A. Thus positioned, a counter-clockwise force moment may again be applied to handle 11 of wrench 10, causing even-numbered pawls 21 to once again exert a counter-clockwise torque on nut head, completing a cycle of torquing and ratcheting.

FIG. 9 shows wrench 10 "flipped over" i.e., rotated 180 degrees around the longitudinal axis of handle 11, and with a hexagonal nut or bolt head A centered in opening 20 of head 12. Thus positioned, wrench 10 may be used to apply a clockwise torque to bolt head A, and ratcheted in a counter-clockwise sense, in a manner exactly analogous to that described above.

Figure 10:
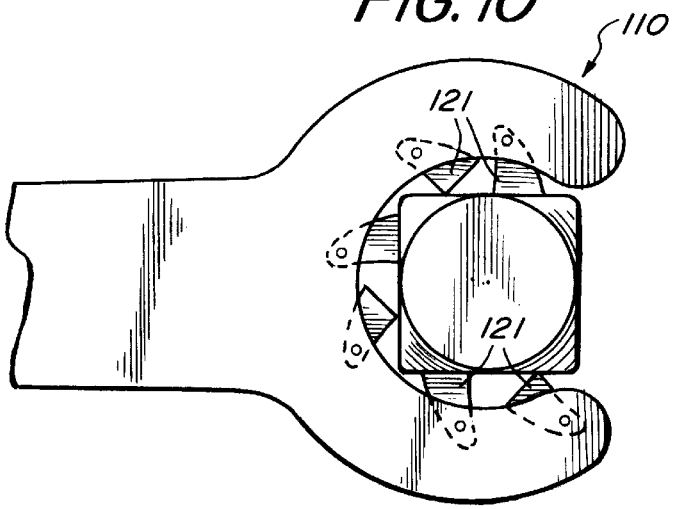
FIG. 10 is a fragmentary sectional view of a modification of the wrench of FIGS. 1–9, useable with square-head nuts.

FIG. 10 shows a modification of the wrench according to the present invention, which is useable with square-headed nuts and bolts. Modified wrench 110 is substantially similar to wrench 10 described above, but uses only 6 pawls 121 circumferentially spaced apart at approximately 60 degree intervals.

FIGS. 10A–10D illustrate another modification of the self-ratcheting open-end wrench according to the present invention. As will be explained below, modified wrench 210, shown in FIGS. 10A and 10B, eliminates the requirement for wedge-shaped stops 30, as shown in FIG. 3.

Figure 10A:
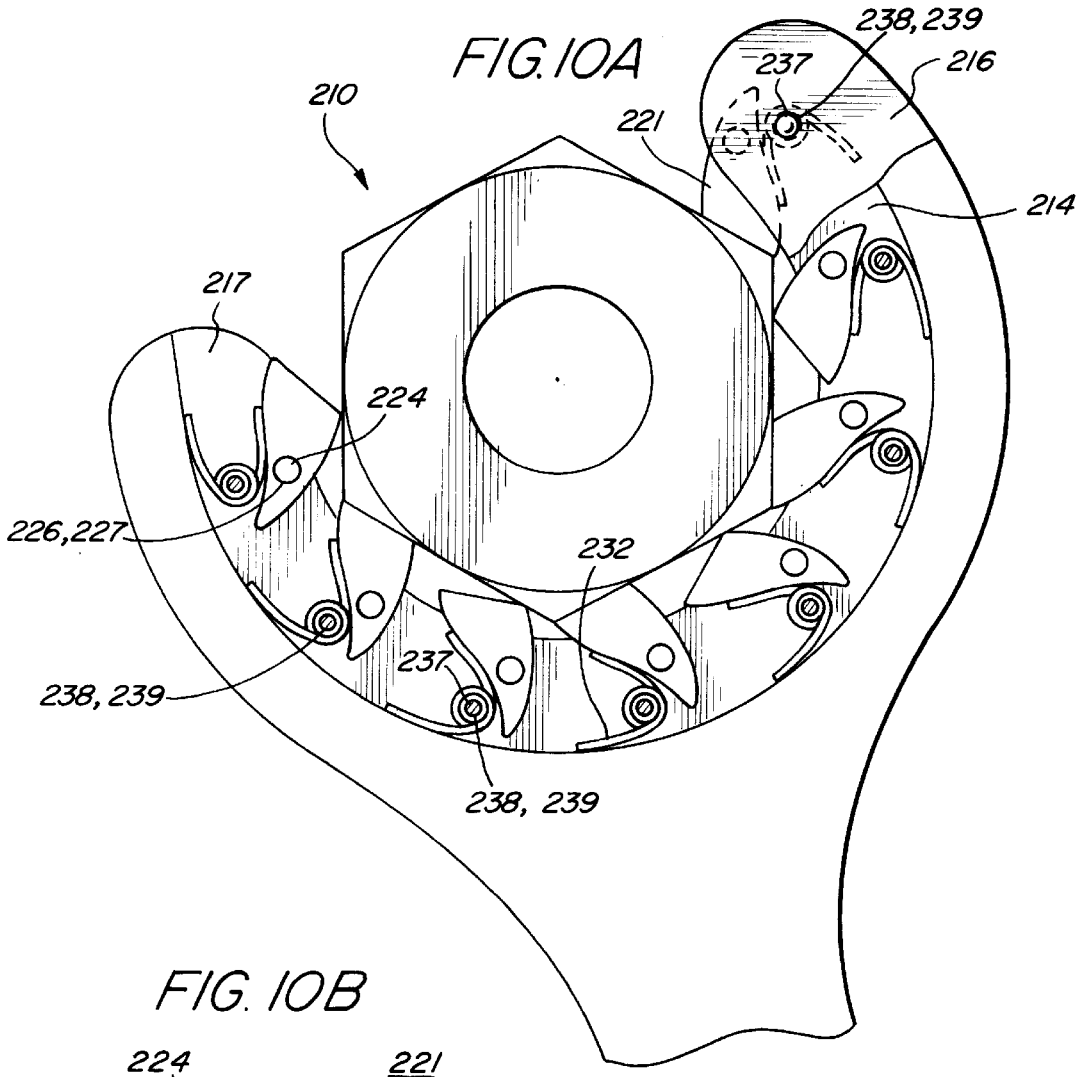
FIG. 10A is a fragmentary sectional view of another modification of the wrench of FIGS. 1–9, having a modified pawl structure.
Figure 10B:
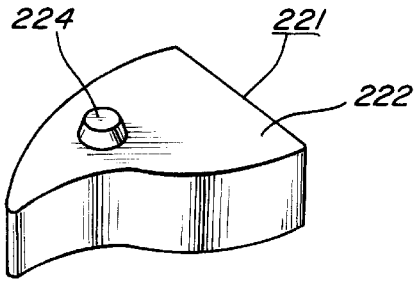
FIG. 10B is a perspective view of a modified pawl used in the wrench of FIG. 10A.
Figure 10C:
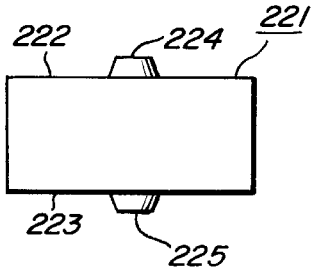
FIG. 10C is an elevation view of the pawl of FIG. 10B.

Referring to FIGS. 10A and 10B, modified wrench 210 utilizes pawls 221 that have a plan-view shape similar to pawls 21 of the basic embodiment 10 of the wrench shown in FIG. 9. As may be seen best by referring to FIGS. 10B and 10C, pawl 221 has formed in the upper and lower parallel wall surfaces 222 and 223 a pair of longitudinally aligned, perpendicularly outwardly projecting, frusto-conically shaped pivot bosses 224 and 225, respectively. Pivot bosses 224 and 225 are rotatably held in holes 226 and 227 provided in the inner facing walls of upper plate 216 and lower web 214, respectively.

Figure 10D:
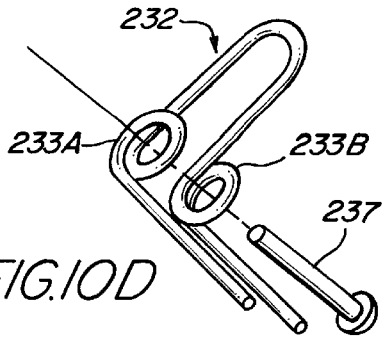
FIG. 10D is an exploded view of part of the wrench of FIG. 10A.

As may be seen best by referring to FIG. 10D, each pawl 221 is elastically biased to its radially innermost position by means of torsion-spring 232. Torsion spring 232 preferably has upper and lower, central longitudinally aligned spiral loops 233A and 233B, respectively, that fit over rivet 237 that serves as a pivot pin for the torsion spring. As shown in FIG. 10A, each rivet 237 is held perpendicularly between upper plate 216 and lower web 217 of wrench 210, in holes 238 and 239, respectively. As may be seen best by referring to FIG. 10A, radial inward motion of each pawl 221 is limited by contact of concave edge wall 240 of each pawl with loops 233A and 233B of torsion spring 232. Motion of loops 223A and 233B in thus limited by contact with a supporting rivet 237. Thus, modified wrench 210 eliminates the requirement for providing separate stop elements formed in web 214 of the wrench, or as required in the basic embodiment of the wrench according to the present invention.

Figure 11:
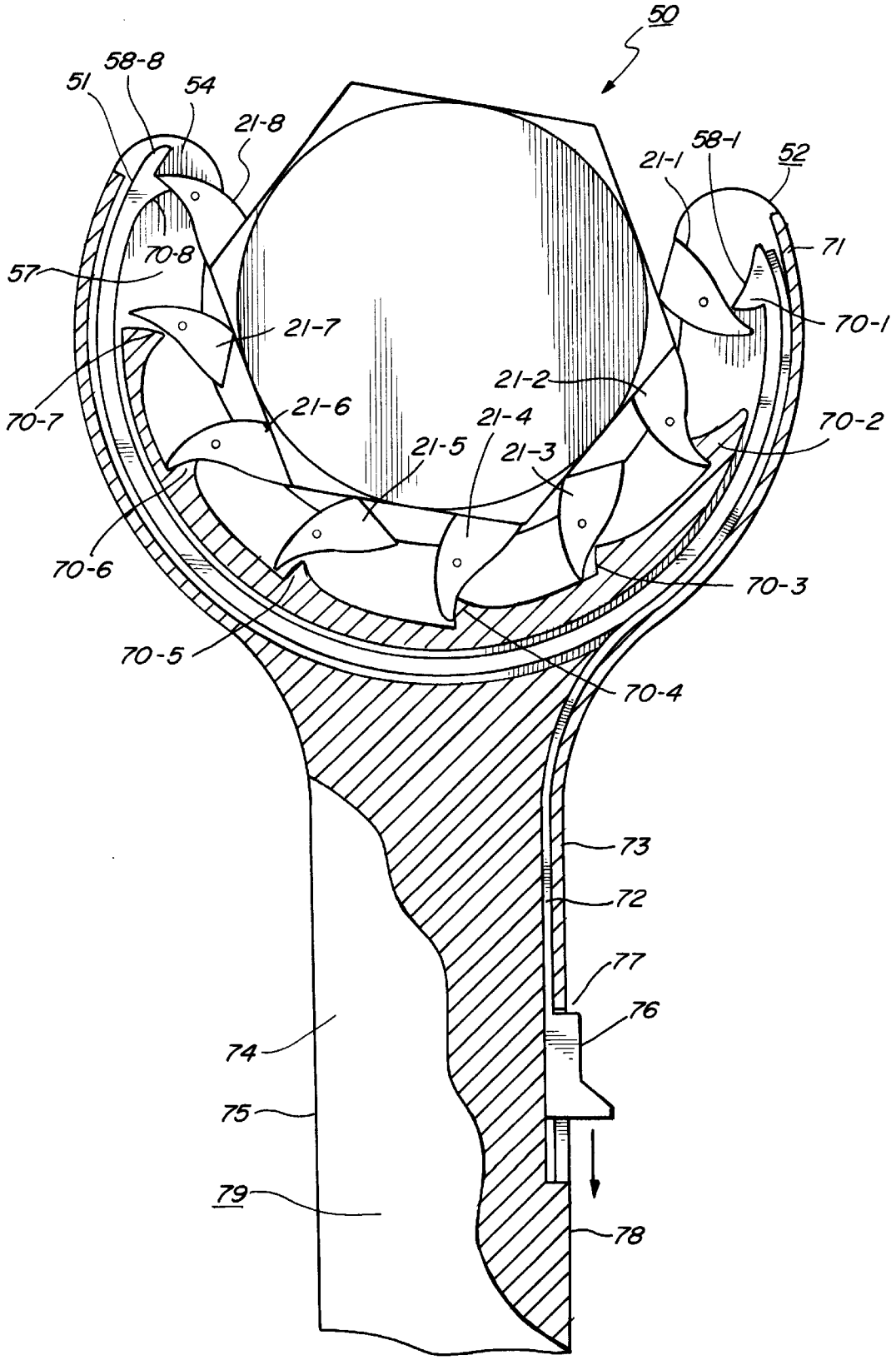
FIG. 11 is a fragmentary sectional view of another modification of the wrench of FIGS. 1–9.
Figure 12:
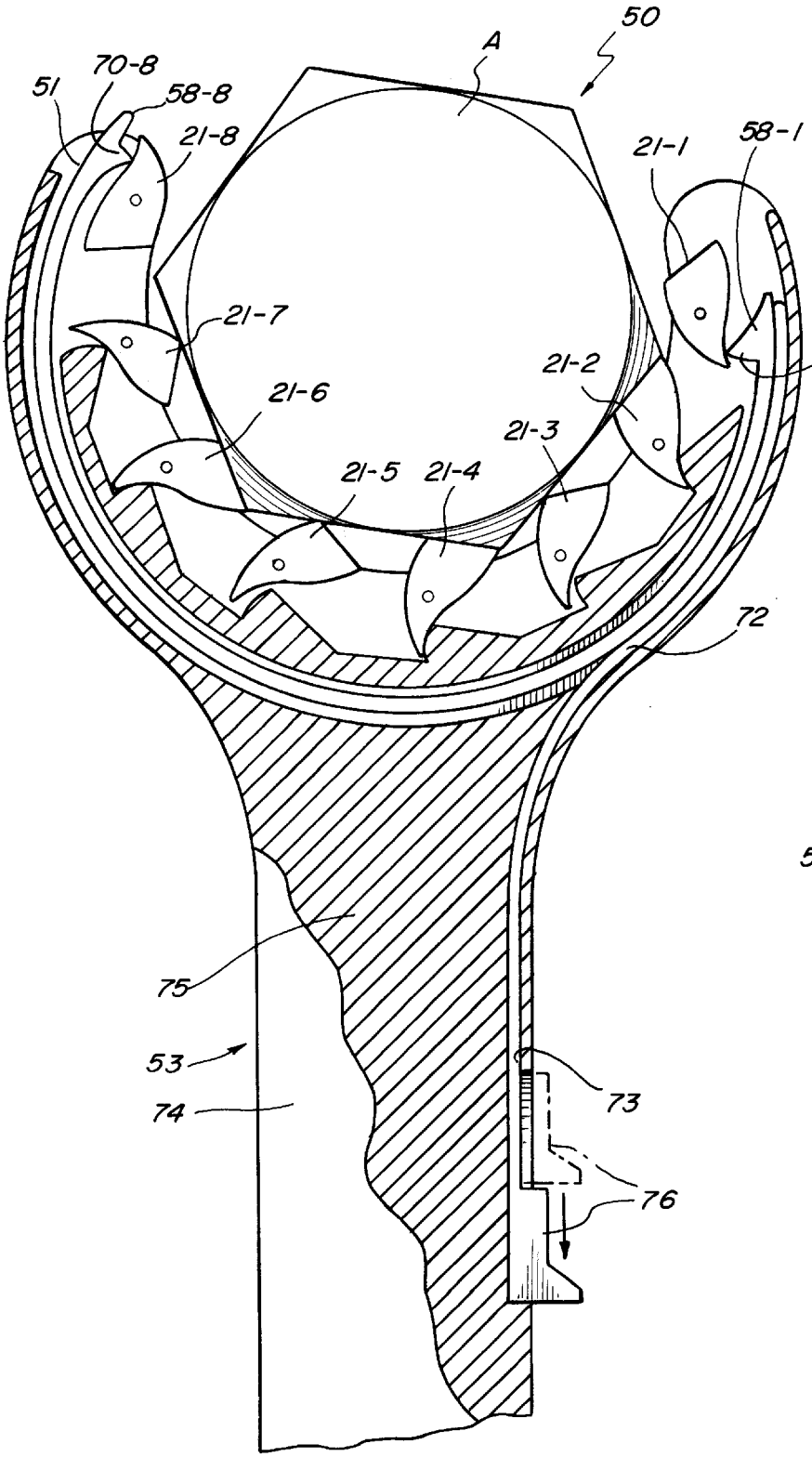
FIG. 12 is a view similar to that of FIG. 11, but showing a release mechanism forming part of the modification in an engaged, or activated position.
Figure 13:
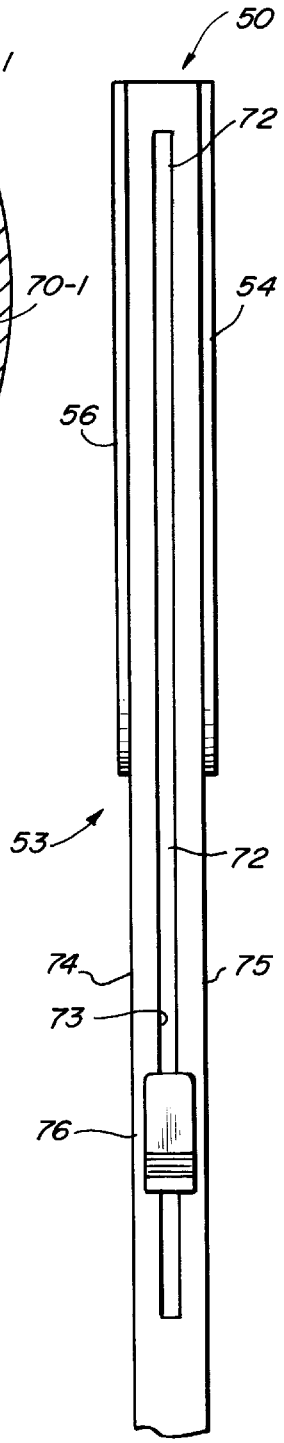
FIG. 13 is a side elevation view of the modified wrench of FIGS. 11 and 12.

FIGS. 11 through 13 illustrate another modification 50 of the open end ratchet wrench according to the present invention. Modified wrench 50 incorporates means for controllably pivoting outermost pawls 21-1 and 21-8 inward to facilitate ratcheting action of the wrench, as will now be explained.

Referring to FIG. 11, modified wrench 50 may be seen to include a thin, generally semiannularly-shaped pawl release ring 51. Pawl release ring 51 is of generally uniform thickness and has an outer diameter slightly less than that of lower crescent-shaped web 54 and upper crescent-shaped cover plate 56 of wrench 50. Pawl release ring 51 is positioned in crescent-shaped space 57 of wrench head 52 in a manner permitting slidable concentric movement therein.

Formed in the two outer circumferential ends 58-1 and 58-8 of semicircular pawl release ring 51 are wedge-shaped stops 70-1 and 70-8 are shaped similarly to stops 70-2 through 70-7 formed in the curved outer transverse wall 71 protruding upwards from lower web 54 of the wrench. With ring 51 positioned as shown in FIG. 9, stops 70-1 and 70-8 perform the same function as stops 70-2 through 70-7. Thus positioned, all stops 70 perform the same function as stops 30 of the basic embodiment 10 of the wrench as described above. However, with ring 51 rotated clockwise as shown in FIG. 10, outer stops 70-1 and 70-7 are moved clockwise, permitting outer pawls 21-1 and 21-8 to pivot further inwards. This pivoting action allows the outer pawls of wrench 50 to become disengaged from faces B of nut A, thus allowing the wrench to be slid longitudinally off of the nut. This capability of wrench 50 for longitudinally engaging and disengaging a nut is particularly advantageous in confined spaces.

Modified wrench 50 includes means for manually rotating ring 51 in the manner described above. Thus, as may be seen best by referring to FIGS. 11 through 13, an elongated, thin, stiff bendable member 72, such as a strip of spring steel, is fastened at one end thereof to pawl release ring 51 near an outer circumferential end of the pawl release ring. Member 72 is threaded through a channel 73 between upper and lower walls 74 and 75 of wrench 50. The lower end of cable 72 is attached to a release button 76. Release button 76 is slidably held within an elongated rectangular slot 77. Slot 77 is disposed longitudinally in an outer longitudinal wall surface 78 of handle 79 of wrench 50.

When release button 76 is moved downwards as shown in FIG. 12, outermost pawls 21-1 and 21-8 are pivoted radially outwards by stops 70-1 and 70-8 at the ends of release ring 51. This action disengages outermost pawls 21-1 and 21-8 from adjacent faces of nut A, allowing wrench 50 to be slid longitudinally (downward in FIGS. 11 and 12) away to a position disengaged from the nut. When the thumb is removed from release button 76, the action of torsion spring 32 on pawls 21 returns release ring 51, release button 76, and outermost pawls 21-1 and 21-8 to their quiescent positions shown in FIG. 11.

Figure 14:
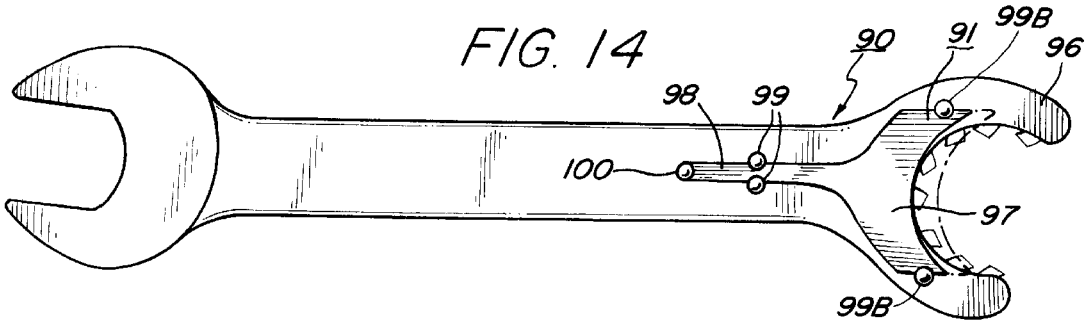
FIG. 14 is an upper plan of another modification of the wrench of FIGS. 1–9, which incorporates locking means for minimizing the likelihood of the wrench slipping up or down on the faces of a nut.
Figure 15:
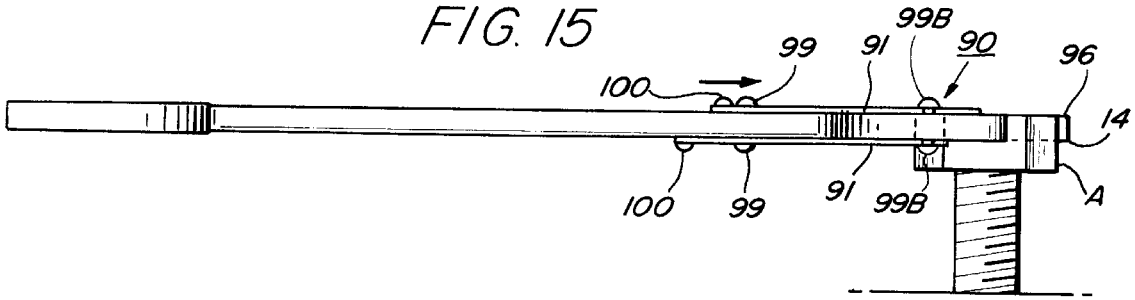
FIG. 15 is a side elevation view of the modified wrench of FIG. 14, showing the wrench in use.
Figure 16:
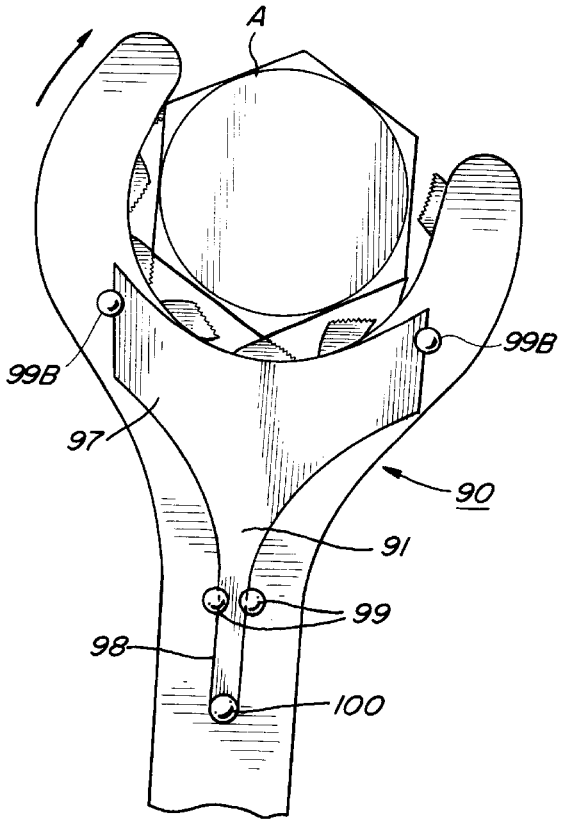
FIG. 16 is a fragmentary enlarged view of the modified wrench of FIG. 14, showing the locking means disengaged.

FIGS. 14–17 illustrate another modification of the wrench shown in FIG. 1. As shown in FIGS. 14 and 15, modified wrench 90 includes a pair of sliding locking plates 91 slidably mounted adjacent upper cover plate 96 and lower web 14 of the crescent-shaped end of the wrench. Each plate 91 has a thin, generally uniform cross section. As shown in FIG. 14, plates 91 have in plan view a generally crescent-shaped outer portion 97 and an elongated inner finger portion 98 which extends inward along the longitudinal axis of handle 11 of the wrench. Finger portion 98 of each plate 91 is slidably held between a pair of grooved, headed pins 99. Crescent shaped outer portion 97 of plate 91 is also slidably held between a pair of grooved, headed pins 99B. Preferably, each plate 91 has an upwardly protruding button 100 located near the rear end of finger portion 98 of each plate 91, to provide convenient means for grasping the plate to permit sliding it inward or outward relative to the end of wrench 90. The purpose of plates 91 is to prevent wrench 90 from sliding up or down off a hexagonal bolt head, as will now be described.

Figure 17:
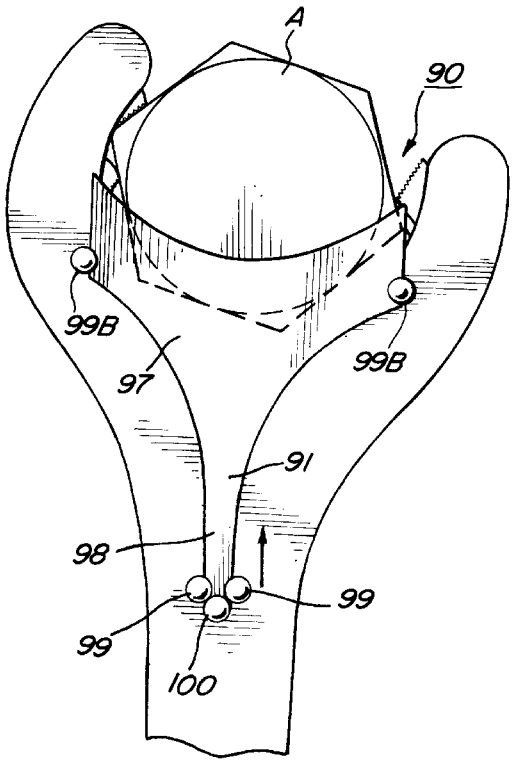
FIG. 17 is a view similar to that of FIG. 16, but showing the locking means in an engaged position.

Referring now to FIGS. 15 and 17, it may be seen that sliding upper locking plate 91 longitudinally outward from the retracted position of the locking plate shown in FIGS. 14 and 15 will cause the lower face of the locking plate to abut the head of a bolt A engaged by wrench 90, should the wrench be moved downward with respect to the bolt head. Thus, as shown in FIG. 15, wrench 90 will remain securely engaged with bolt A even if a downward normal force is exerted on the wrench, when upper locking plate 91 is in its outwardly extended position. If it is more likely that an upward force be inadvertently exerted on wrench 90, upper locking plate can be slid inward to the disengaged position shown in FIG. 14. Then wrench 90 may be slid downward along the longitudinal axis of bolt A sufficiently far for the upper surface of lower locking plate 91 to lie below the lower surface of bolt head A. At this position, lower locking plate 91 may be slid longitudinally outward along the longitudinal axis of wrench 90, causing the lower locking plate to engage the lower surface of bolt head A, and thereby preventing the wrench from sliding upward off the bolt head.

FIGS. 18–25 illustrate another modification of the wrench shown in FIG. 1. Modified wrench 110 incorporates novel means for holding a nut or bolt prior to the fastening the nut onto a threaded stud, or screwing the bolt into a threaded hole, as will now be described.

Figure 18:
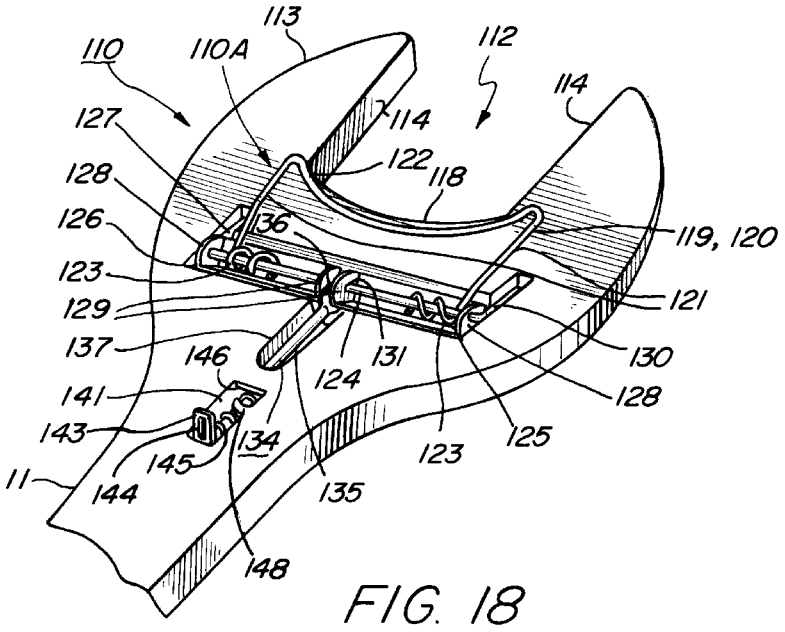
FIG. 18 is a fragmentary perspective view of a modification to the open-end portion of the wrench of FIG. 11, the modification providing a nut-holding capability.
Figure 19:
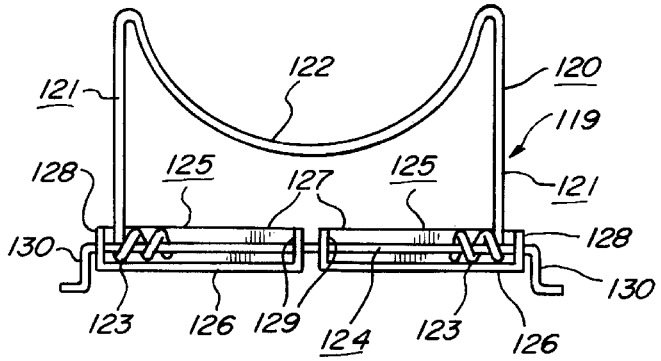
FIG. 19 is a perspective view of a clip comprising part of the wrench of FIG. 18.

Referring now to FIGS. 18 and 19, it may be seen that open end 113 of wrench 110 has a conventional crescent shape, with a generally rectangular-shaped opening 112 having a pair of parallel flat inner jaw faces 114 adapted to receive opposed parallel faces of a polygonally-shaped nut or bolt head. As may be seen best by referring to FIGS. 18–20, a pair of identical shallow rectangular grooves 115 are provided in both the upper lateral surface 116 and lower lateral surface 117 of wrench 110, longitudinally inward from the inner transverse face 118 of opening 112. Each groove 115 slidably contains a nut-holding clip 119, the detailed construction of which may be best understood by referring to FIG. 19.

As shown in FIG. 19, nut-holding clip 119 includes a nut-engaging bale 120 formed from stiff spring wire and having two parallel longitudinally disposed side members 121, and a serpentinely curved, concave outer transverse leg 122. The inner end of each side member 121 of bale 120 has a short, helically curved end portion 123 which protrudes transversely inwards towards the longitudinal center line of bale 120. End portions 123 of bale 120 coaxially encircle an elongated straight pivot rod 124, and are free to rotate around the pivot rod. A pair of elongated two-sided rectangular channel members 125 are also rotatably mounted on pivot rod 124. Each channel member 125 has a lower or inner transversely disposed side wall 126 of elongated rectangular shape, and an upper or outer transversely disposed side wall 127 of similar shape. An outer longitudinally disposed, generally square-shaped end wall 128 joins the outer ends of side walls 126 and 127, forming therewith a two-sided channel. A similarly shaped and oriented inner longitudinal end wall 129 joins the inner ends of side walls 126 and 127. Aligned holes 130 and 131 through outer and inner end walls 128 and 129, respectively, rotatably receive pivot rod 124. Thus positioned, each of the two adjacent channel members 125 partially encloses a separate helically curved end portion 123 of bale 120.

As shown in FIG. 19, each outer longitudinal end of pivot rod 124 has a short crank portion 130 consisting of two right-angle bends. As may be seen best by referring to FIG. 22, the outer end of each crank portion 130 of pivot rod 124 is slidably contained in a longitudinally disposed groove 131 which extends laterally outwards into the head 132 of wrench 110 from the outer longitudinal walls 133 of grooves 115 in the upper and lower surfaces of wrench 110.

Figure 20:
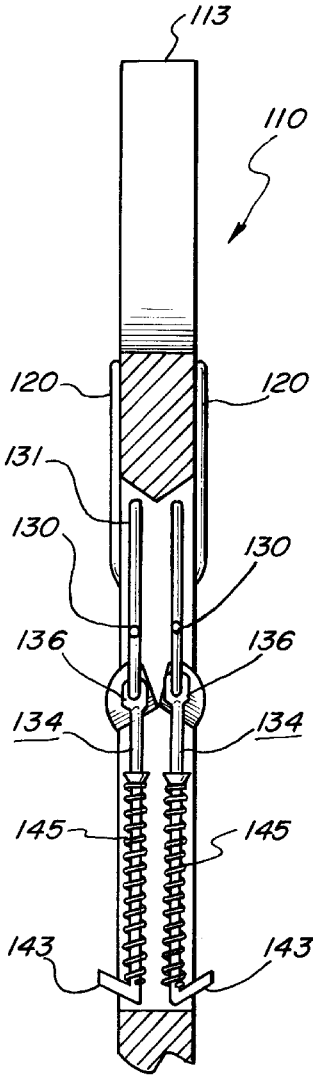
FIG. 20 is a sectional view of the wrench of FIG. 18, taken along line 20—20.
Figure 21:
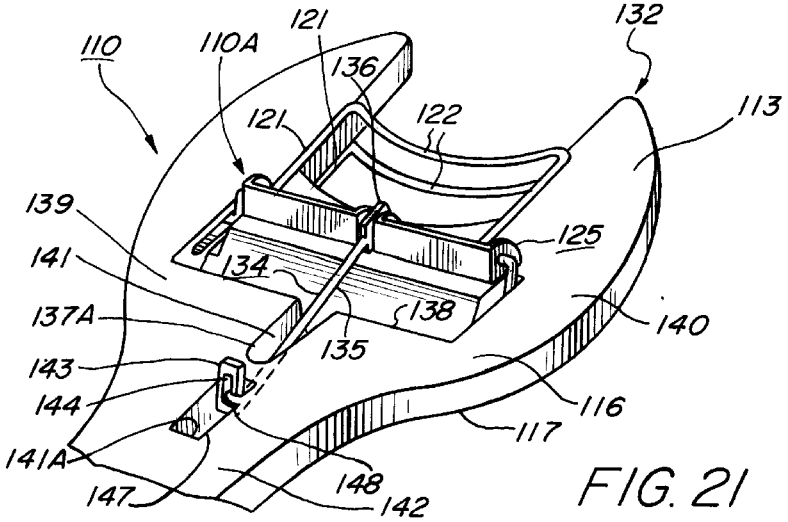
FIG. 21 is a view similar to that of FIG. 18, but showing nut-holding clips comprising part of the wrench in a forward, operable position.

As may be seen best by referring to FIGS. 18, 20 and 21, each nut retainer clip assembly 110A includes an actuator rod or push rod 134 which is effective in moving each clip assembly from a non-operating position, as shown in FIG. 18, to an operable position, as shown in FIG. 21, as will now be explained.

As may be seen best by referring to FIG. 18, actuator rod 134 has an elongated straight shank 135 having at a forward end thereof an eye or perforation 136 which rotatably receives pivot rod 124. Eye 136 is positioned laterally between inner longitudinal end walls 129 of a pair of adjacent rectangular channels 125.

Shank 135 of actuator rod 134 is slidably contained within a longitudinally disposed bore 137 which extends rearward from the rear transverse wall 138 of shallow spring slip groove 115 into the rear portion 139 of web 140 of head 132 of wrench 110. In the preferred embodiment of wrench 110, a forward portion of bore 137 has its outer wall surface removed to form a longitudinally disposed groove 141, thereby allowing outward motion of a portion of actuator rod 134.

The rear end portion of shank 135 of actuator rod protrudes into a deep, elongated cavity or aperture 141 provided in both upper and lower surfaces of handle 142 of wrench 110. As may be seen best by referring to FIG. 18, the rear end of actuator rod 134 has an angled finger tab 143 which protrudes outwards from cavity 141, beyond the outer lateral surface of wrench 110. Actuator rod 134 is biased to a rearward position, in which finger tab 143 abuts rear wall 144 of cavity 141, by means of a helical compression spring 145 which encircles the actuator rod and which is disposed between the finger tab and the front wall 146 of cavity 141.

One longitudinally disposed side wall 147 of cavity 141 has protruding inwards therefrom a forwardly curved hook 148. As may be seen best by referring to FIG. 21, the purpose of hook 148 is to engage and hold the rear surface of the finger tab in a forward position, against the extensional force of spring 145, thereby holding bales 120 in a forward, operable position. Preferably, the rear surface of finger tab 143 is provided with a slotted indentation or perforation 144 adapted to be positively engaged by the pointed tip of hook 148.

The way in which wrench 110 may be used to hold a nut or bolt while transporting the nut or bolt to a location where the wrench may be used to screw the nut onto a threaded stud or screw the bolt into a threaded hole may be best understood by referring to FIGS. 21 through 25.

Figure 22:
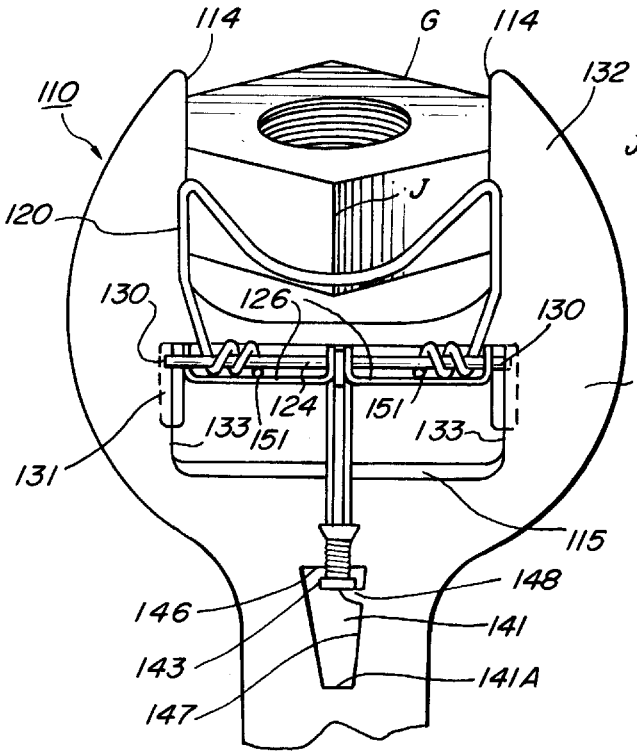
FIG. 22 is an upper plan view of the wrench of FIG. 18, showing a nut being inserted into the jaws of the wrench.
Figure 23:
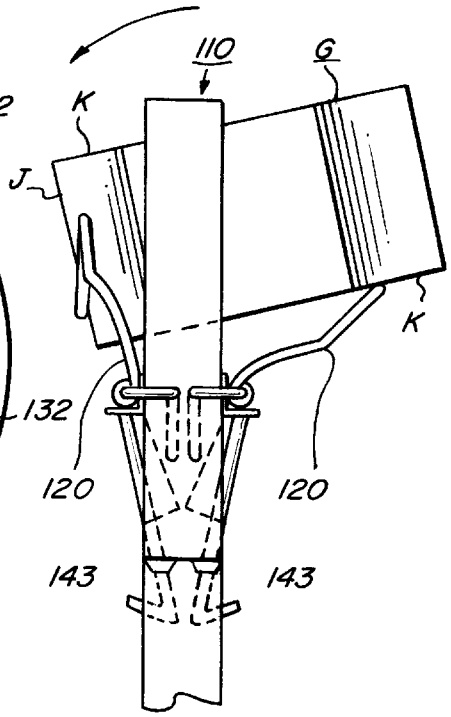
FIG. 23 is a side elevation view of the wrench and nut of FIG. 22, showing the nut partially engaged by clips of the wrench.
Figure 25:
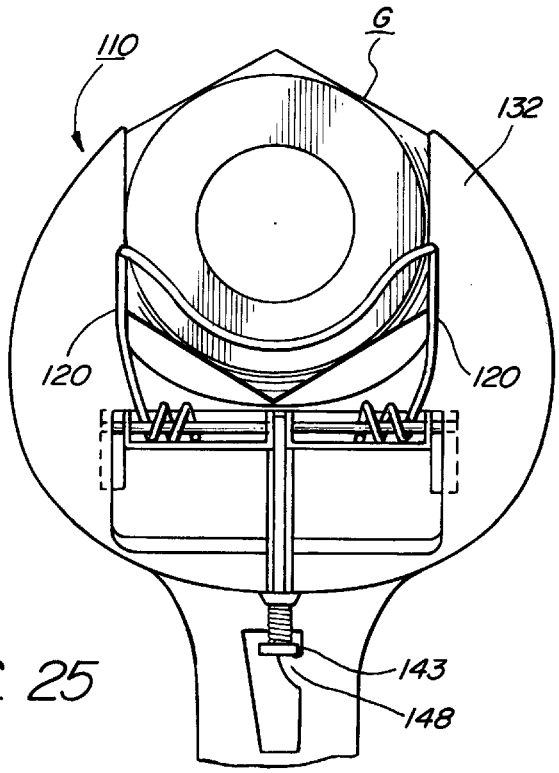
FIG. 25 is an upper plan view of the wrench and nut of FIG. 24.
Figure 24:
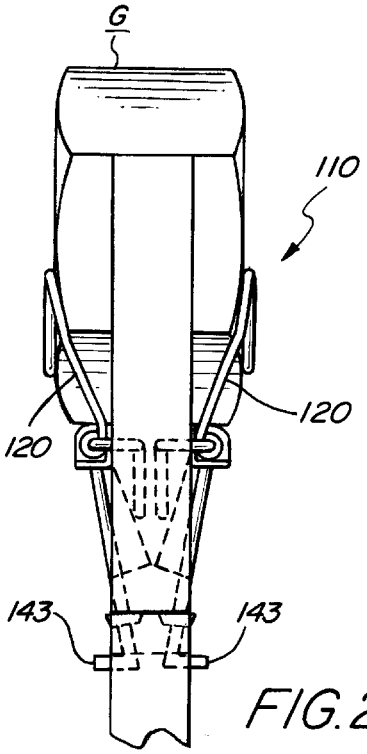
FIG. 24 is a side elevation view similar to FIG. 23, but showing a nut secured within clips of the wrench.

As shown in FIG. 21, the nut retainer clip assemblies 110A on either or both sides of wrench 110 are first moved forward towards a position overlying part of open end 113 of the wrench. This operation is performed by pushing finger tab 143 of actuator rod 134 forward against the extensional force of spring 145 beyond hook 148, and then engaging the rear surface of finger tab with the front surface of the hook. Then, as shown in FIG. 22, a nut G (or head of a bolt) is inserted between opposed inner jaw faces 114 of head 132 of wrench 110. Initially, the longitudinal axis of nut G may be inclined with respect to the longitudinal axis of head 132 of wrench 110. Then, a vertex J between adjacent faces H of nut G is pressed against the outer concave edge of a bale 120. Pivotal motion of a bale 120 outward on pivot rod 124 is resiliently resisted by the contact of inner ends 151 of helically curved end portions 123 of bale 120 with wall 126 of channel 125. As nut G is rotated into longitudinal alignment with inner jaw faces 114 of wrench 110, as shown in FIG. 23, bales 120 resiliently bear against either a vertex J of the nut, or against a lateral face K of the nut. When nut G has been rotated into complete longitudinal alignment with wrench 110, as shown in FIGS. 24 and 25, bales 120 resiliently bear against opposite lateral faces K of nut G, securely holding the nut in head 132 of wrench 110. Thus positioned, nut G can be conveniently transferred to and threaded onto a bolt or stud, even if the latter are in hard to reach locations. Once the nut has been started, nut retainer clip assemblies 110A may be retracted to their non-operating positions, as shown in FIG. 18. Retraction is accomplished by pushing finger tab 143 forward slightly against the extensional force of spring 145, and moving the finger tab away from hook 148, allowing the spring to retract nut retainer assembly 110A rearward until the finger tab abuts rear wall 144 of cavity 141. It should be noted that a mechanism employing nut retainer clip assemblies 110A could also be incorporated into the novel ratcheting head 12 of wrench 10 that was described above.

It should be apparent from the foregoing discussion of the structure and function of the embodiments of a novel open-end ratchet wrench according to the present invention that the invention provides a highly effective and advantageous improvement to the state of the art of hand tools.

Although the preferred embodiments of the invention described above employ a crescent-shaped, open-end construction, the novel ratcheting mechanism disclosed could be used in a box-end wrench.

What is claimed is:

1. In a wrench having an elongated handle and an enlarged web at an end thereof, said web having generally flat upper and lower surfaces and a transversely disposed aperture therethrough adapted to transversely receive the head of a bolt, nut or similar headed fastener, and apply a torque thereto, the longitudinal axis of said fastener being disposed transversely to the longitudinal axis of said handle of said wrench, the improvement comprising a locking mechanism for preventing said wrench from becoming disengaged from said fastener head by motion of said wrench having a component along the longitudinal axis of said fastener, said locking mechanism comprising;

a. a locking plate of general thin, uniform thickness, said locking plate being located parallel to an adjacent one of said upper or lower surfaces of said web, said locking plate having a generally crescent-shaped front longitudinal end portion having an inner opening sufficiently large to partially circumscribe a portion of said aperture through said web, and b. fastening means slidably joining said locking plate to said wrench, said fastening means adapted to permit slidable movement of said locking plate longitudinally forward along the longitudinal axis of said wrench from a retracted, non-operating position to an extended, operating position in which said crescent-shaped front longitudinal end portion of said locking plate at least partially overlies or underlies, respectively, an upper or lower surface of said head of said fastener, thereby preventing upward or downward movement, respectively, of said fastener head through said web aperture of said wrench, said fastening means comprising in combination;

i. an elongated finger section protruding rearward from said crescent-shaped portion of said locking plate, along the longitudinal axis of said wrench, and ii. means longitudinally slidably joining said finger section of said locking plate to said wrench, said longitudinally slidable joining means comprising a pair of headed bosses protruding upwards from said handle on opposite lateral sides of said finger section, the head of each of said bosses having an undercut region for slidably receiving said finger and an overlying portion adapted to hold said finger section in parallel alignment with the flat underlying surface of said handle of said wrench.

2. The locking mechanism of claim 1 wherein said finger section of said locking mechanism has near the inner end thereof an upwardly protruding handle boss adapted to limit longitudinal outward movement of said locking plate upon abutting said headed bosses.

3. In an open-end wrench having an elongated handle and a working head including an enlarged web at one end thereof, said web having generally flat upper and lower lateral surfaces and an opening in an outer longitudinal end thereof, said opening having on opposite lateral sides thereof a pair of jaws having parallel flat inner jaw faces adjacent thereto adapted to engage opposed parallel faces of a polygonally-shaped nut, bolt head or similar fastener, the improvement comprising a fastener retainer mechanism adapted to hold a fastener within said jaws while transporting said fastener to an installation location, said retainer mechanism comprising;

a. a pair of opposed retainer members adjacent said upper and lower surfaces of said web, said retainer members being resiliently biased to exert compressive forces directed towards said upper and lower surfaces of said web, and b. fastening means adapted to permit slidable movement of said retainer members longitudinally outwards along the longitudinal axis of said wrench from a retracted, non-operating position to an extended, operating position in which said retainer members exert a compressive retaining force on upper and lower transverse faces of said fastener.

4. The retainer mechanism of claim 3 wherein each of said retainer members comprises a spring clip having opposed generally longitudinally disposed legs, and an arcuately shaped outer transverse leg.

5. The retainer mechanism of claim 4 wherein said spring clip includes a coaxial pair of opposed inner transversely disposed legs, one each extending perpendicularly from each longitudinally disposed leg.

6. The retainer mechanism of claim 5 further including means for slidably holding said inner legs of said spring clips.

7. The retainer mechanism of claim 6 wherein said inner legs of said spring clips are further defined as being wound into a helical coil.

8. The retainer mechanism of claim 7 wherein said fastening means adapted to permit slidable movement of said retainer members includes in combination a pivot rod disposed coaxially through said coiled inner legs of said spring clip, and means for supporting said pivot rod transversely with respect to said wrench and longitudinally slidable with respect thereto.

9. The retainer mechanism of claim 8 further including a shallow, rectangular generally rectangularly shaped laterally elongated groove in said flat lateral surface of said web, longitudinally inward of said opening in said web, said groove being adapted to receive said retainer member when said retainer member is in a retracted, non-operating position.

10. The retainer mechanism of claim 9 further including an actuator rod pivotably attached to said pivot rod, said actuator rod being longitudinally slidable to a first retracted position effective in holding said retainer member in a retracted position and longitudinally slidable to a second, extended position effective in holding said retainer member in an extended, operable position.

11. The retainer mechanism of claim 9 wherein said actuator rod is elastically biased to said first, retracted position.

12. The retainer mechanism of claim 11 further including means for locking said actuator rod in an extended, operating position.

13. The retainer mechanism of claim 9 wherein said means for slidably supporting said pivot rod comprises in combination a pair of right angle bends in each transverse end of said pivot rod transversely outward of said coiled inner leg of said spring clips, and a longitudinally disposed blind groove extending laterally outwards into said web from an outer lateral wall of said shallow groove, whereby said pivot rod may be slid longitudinally forward in said blind groove, and pivoted outward from said shallow groove.

14. The retainer mechanism of claim 13 further including means for elastically biasing said spring clip downwards into said shallow groove.

* * * * *